US008448304B2

(12) United States Patent
Tsao

(10) Patent No.: US 8,448,304 B2
(45) Date of Patent: May 28, 2013

(54) ZIPPER TOOTH STRUCTURE AND THE ZIPPER COMPOSED THEREOF

(76) Inventor: Chang-Wen Tsao, Luchu (TW)

( * ) Notice: Subject to any disclaimer, the term of this patent is extended or adjusted under 35 U.S.C. 154(b) by 275 days.

(21) Appl. No.: 12/801,016

(22) Filed: Jul. 9, 2010

(65) Prior Publication Data

US 2010/0306970 A1 Dec. 9, 2010

(51) Int. Cl.
*A44B 19/04* (2006.01)

(52) U.S. Cl.
USPC ..... 24/412

(58) Field of Classification Search
USPC ..... 24/406, 412, 403, 408, 409, 411, 24/413, 414
See application file for complete search history.

(56) References Cited

U.S. PATENT DOCUMENTS 2,644,995 A * 7/1953 Morin ..... 24/405
3,886,634 A * 6/1975 Murata ..... 24/410
4,263,698 A * 4/1981 Moertel ..... 24/412

* cited by examiner

*Primary Examiner* — James Brittain

(57) ABSTRACT

A zipper (60) which can prevent the teeth disengagement from overbending or twisting force includes pluralities of teeth (1), wherein each tooth (1) comprises of a clamp portion (7) having a slit (2) for receiving a fabric tape, and one side thereof forms a left wall (12) of said tooth (1); a hook portion (3) is extended from another side the clamp portion (7) forming a dimple (8) and a right wall (11) of said tooth (1); a slot (4) parallel to said slit (2) is provided on an outer wall of said hook portion (3); a blocking member (5) parallel to said slot (4) is provided at said dimple (8); and a projected joint member (6) is provided onto said right wall (11) where is close to the slot (4).

4 Claims, 8 Drawing Sheets

ZIPPER TOOTH STRUCTURE AND THE ZIPPER COMPOSED THEREOF

FIELD OF THE INVENTION

The present invention relates to an improving structure of a tooth and a slide fastener composed of said tooth.

DESCRIPTION OF PRIOR ART

Zipper is a slide fastener which joins two edges of fabric temporarily. It is widely used in clothing (e.g. jacket or pants), bags, boots and other items. A conventional zipper (20), as shown in FIGS. 1 to 4, consists of two fabric tapes (30), each has a row of teeth (10), and each tooth is fixed thereon by a clamp portion (160). A slider (not shown) with a Y-shape channel meshes two rows of teeth. For interlocking the teeth (10), each tooth (10) includes a dimple (130) on the top and bottom thereof, forming an oval-like projection (120) on a side; a bottom and a top dimple (130) of two teeth (10) of the same row locks the projection (120) of the tooth (1) of another row, and semispherical shape of dimple (130) leaves a space (110), allowing the zipper (20) can be bent. To secure the fixture further, a groove (150) is provided on the top of the projection (120) and a corresponding projected member (140) is set on a side of the dimple (130), thus when the dimple (130) engages the projection (120), the member (140) is inserted into the groove (150), as illustrated in FIGS. 3 and 4.

Although the zipper provides faster time than buttons, the conventional zipper possesses following defects:

1. The space (110) is left for allowing the zipper (20) can be bent. However, when it is bent over an angle of 150 degree or pressed by force, the engagement of projection (120) and the dimple (130) may be loosened, and the member (140) disengages from the groove (150), causing the disengagement of the teeth (10). Such disengagement can damage the projection (120) and dimple (130), and loosen the engagement between teeth (10). It can also produce unsmooth surface over the zipper (20) which jams the slider. Therefore, to develop a zipper in which the teeth will not be disengaged and damaged by overbending or excessive force has become the main objective of the present invention.
2. The teeth (10) of the conventional zipper (20) are arranged in a zigzag fashion, and since the projection (120) is held by dimples (130) of two teeth (10), the juncture is not affixed securely. Therefore, to change the arranging fashion of teeth (10) of the zipper (20) to secure the engagement has become another objective of the present invention.

SUMMARY OF THE INVENTION

To achieve foregoing objectives, a tooth (1) of a slide fastener comprises of:

a clamp portion (7) is provided on a side, having a slit (2) for receiving a fabric tape, one end of said clamp portion (7) forms a left wall (12) of said tooth (1);

a hook portion (3) is extended from another end of the clamp portion (7) forming a dimple (8) and a right wall (11) of said tooth (1);

a slot (4) parallel to said slit (2) is provided on an outer wall of said hook portion (3);

a blocking member (5) parallel to said slot (4) is provided at said dimple (8); and a projected joint member (6) is provided onto said right wall (11) where is close to the slot (4).

A zipper or a slide fastener composed of said tooth (10) consists essentially of a left and right fabric tapes (30, 30A), each has a row of indentations corresponding each other to form a chain (40) and a slider (50) for meshing and separating said indentations of two fabric tapes (30, 30A); characterized in that: each indentation of said left and right fabric tape (30, 30A) is the tooth (1). The tooth (1) is affixed to the left and right fabric tape (30) by the clamp portion (7); the hook portion (3) of each tooth (1) of left fabric tape (30) engages the dimple (8) of each tooth (1) of said right fabric tape (31). The slot (4) of each tooth (1) of said left fabric tape (30) accommodates the blocking member (5) of each tooth (1) of said right fabric tape (31A); and the joint member (6) of each tooth (1) of left fabric tape (30) butts the joint member (6) of each tooth (1) of said right tape (30A).

The right wall (11) and the left wall (12) of each tooth (10) are parallel and the right-triangular-like joint member (6) butts each other by the angled face (61) is allowed to have two shapes, one has a right triangular shape with an angled face (61) and another in an echelon shape having a parallel top and bottom face (62, 63) and the angled face (61). The angled face (61) of the joint member (6) butts each other, creating space between the teeth (10), allowing movability when the teeth (10) are interlocked; and attached angled faces (61) give more flexibility to the invention.

For interlocking the teeth (10), a hook portion (3) of one tooth (10) and a dimple (8) of another tooth (10) are engaged, thus the left wall (12) of one contacts the right wall (11) of another, arranging the interlocking teeth (10) in a horizontal fashion and forming an interlocking pair. The chain (40) of the zipper (60) comprises of pluralities of the interlocking pair and each pair functions independently, which is distinctive to the conventional zigzag arrangement. Said engagement affixes the teeth (10) more securely than in a zigzag fashion, avoiding teeth (10) be separated easily as the zipper is bent or pressed by excessive force and the arrangement ensures the function can be performed correctly even when an interlocking pair fails.

DETAILED DESCRIPTION OF PREFERRED EMBODIMENTS

Figure 1:
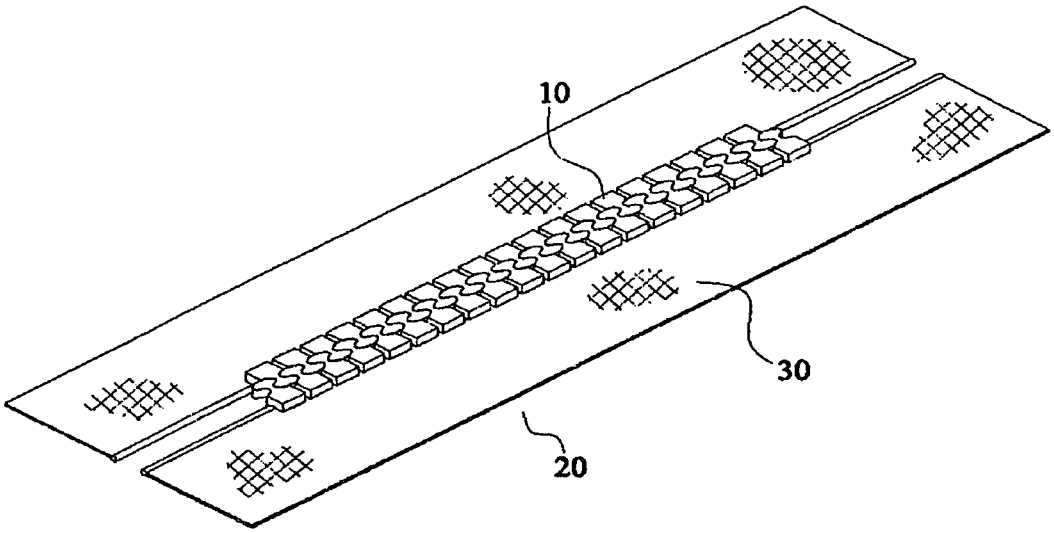
FIG.1 (Prior Art)
FIG. 1 is a schematic view of a conventional zipper.
Figure 2:
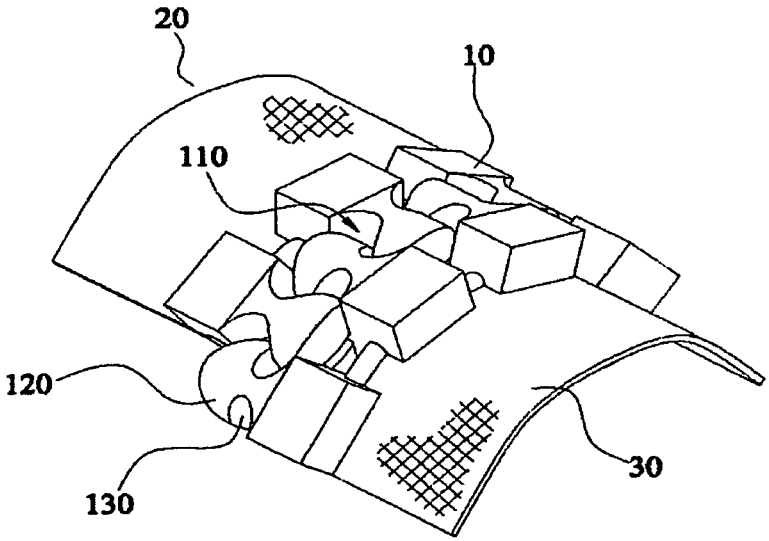
FIG.2 (Prior Art)
FIG. 2 is an enlarged view of the zipper of FIG. 1 as the zipper is bent.
Figure 3:
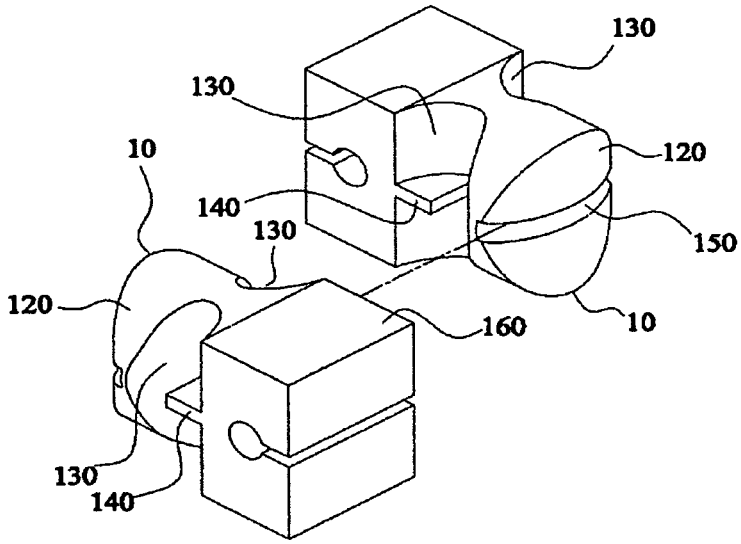
FIG.3 (Prior Art)
FIG. 3 is a schematic view showing two separated teeth of the conventional zipper.
Figure 4:
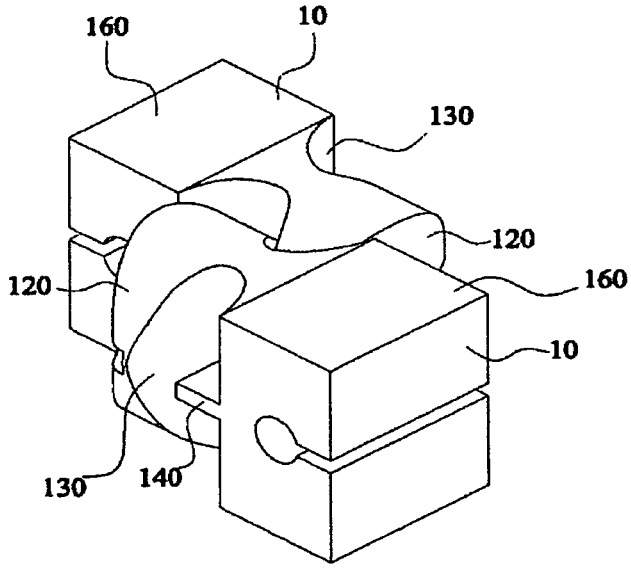
FIG.4 (Prior Art)
FIG. 4 is a schematic view showing the engagement of teeth of said conventional zipper.
Figure 5:
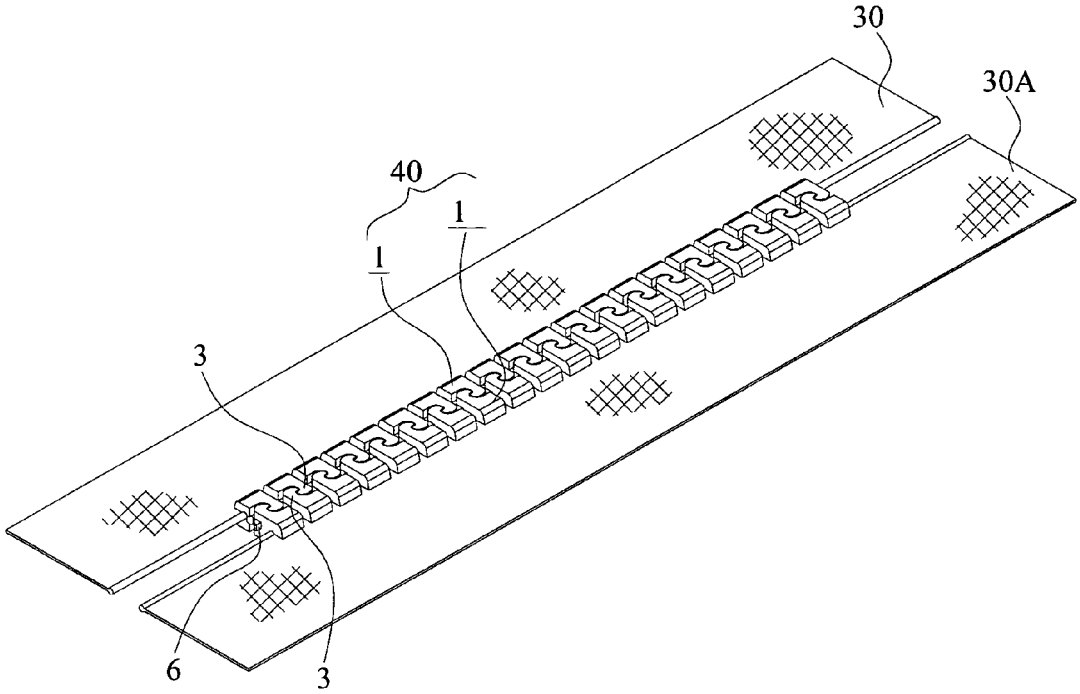
FIG. 5 is a schematic view of the present invention.
Figure 6:
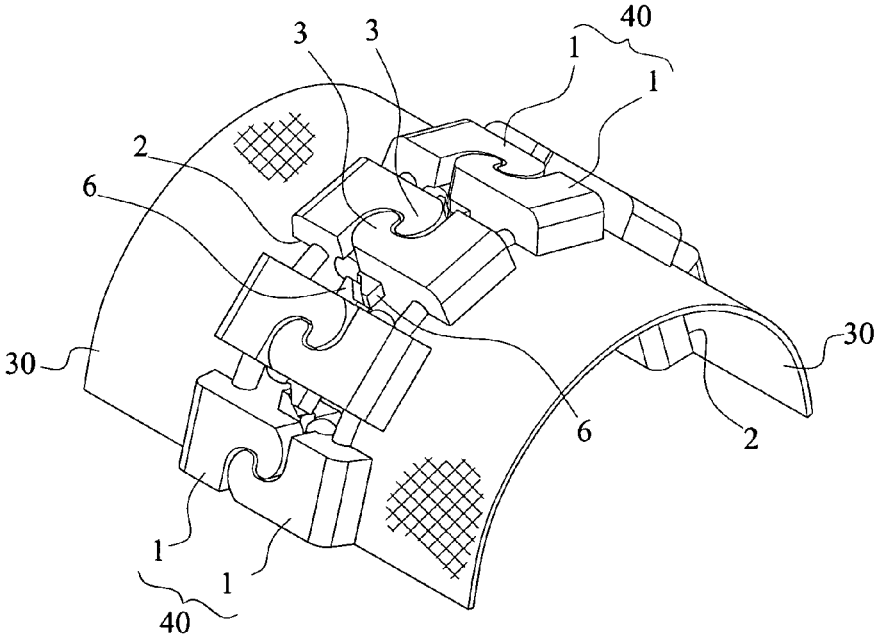
FIG. 6 is an enlarged view of the zipper of FIG. 5 as the zipper is bent.

The preferred embodiment of the present invention are described in detail according to appended drawings hereinafter.

Referring to FIGS. 5-8, a metal or plastic tooth (1) of a slide fastener consists of a clamp portion (7) is provided on a side, having a slit (2) for receiving a fabric tape, one end of said clamp portion (7) forms a left wall (12) of said tooth (1); a hook portion (3) is extended from another end of the clamp portion (7) forming a dimple (8) and a right wall (11) of said tooth (1); a slot (4) parallel to said slit (2) is provided on an outer wall of said hook portion (3); a blocking member (5) parallel to said slot (4) is provided at said dimple (8); and a projected joint member (6) is provided onto said right wall (11) where is close to the slot (4).

Figure 12:
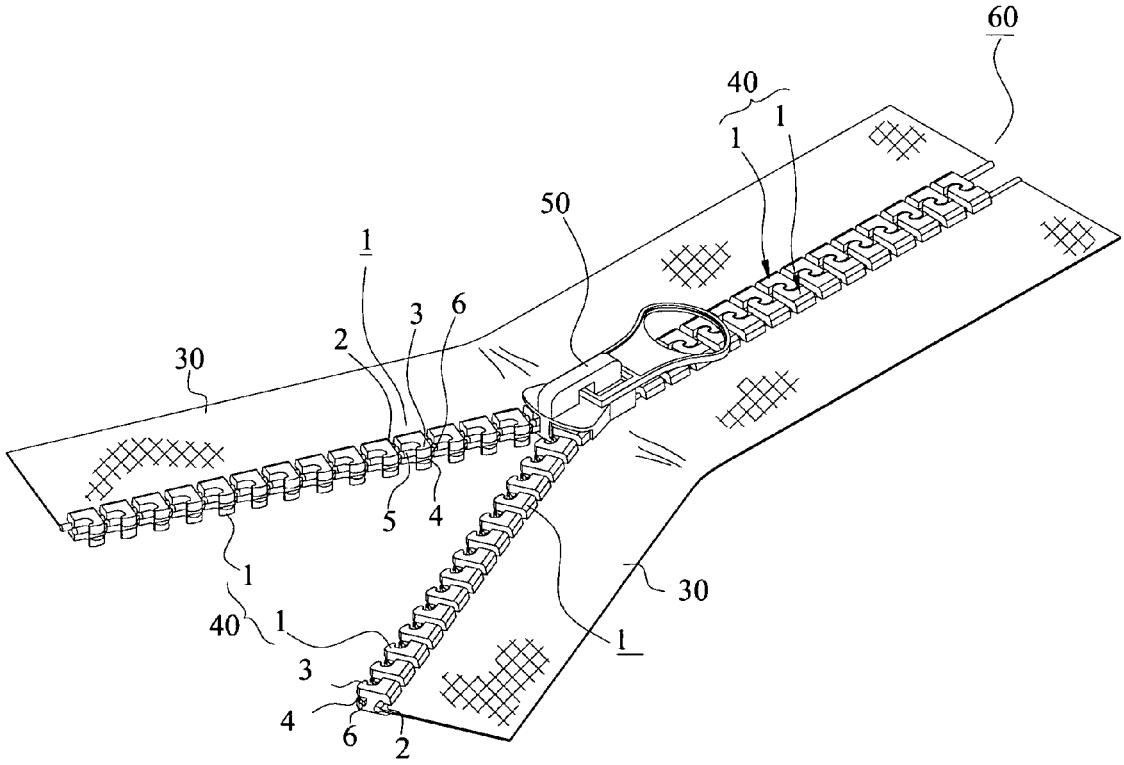
FIG. 12 is a schematic view showing the present zipper separated by a slider.

A zipper (60), composed of said tooth (1) is shown in FIG. 12. Said zipper (60) includes a left and a right fabric tape (30, 30A), each has a row of indentations corresponding with each other to form a chain (40) and a slider (50) for meshing and separating the indentations of two fabric tapes (30, 30A). The zipper (60) is characterized in that each indentation of said left and right fabric tape (30, 30A) is the tooth (1). The tooth (1) is affixed to the left and right fabric tape (30) by the clamp portion (7); the hook portion (3) of each tooth (1) of left fabric tape (30) engages the dimple (8) of each tooth (1) of said right fabric tape (31). The slot (4) of each tooth (1) of said left fabric tape (30) accommodates the blocking member (5) of each tooth (1) of said right fabric tape (31A); and the joint member (6) of each tooth (1) of left fabric tape (30) butts the joint member (6) of each tooth (1) of said right tape (30A).

Figure 9:
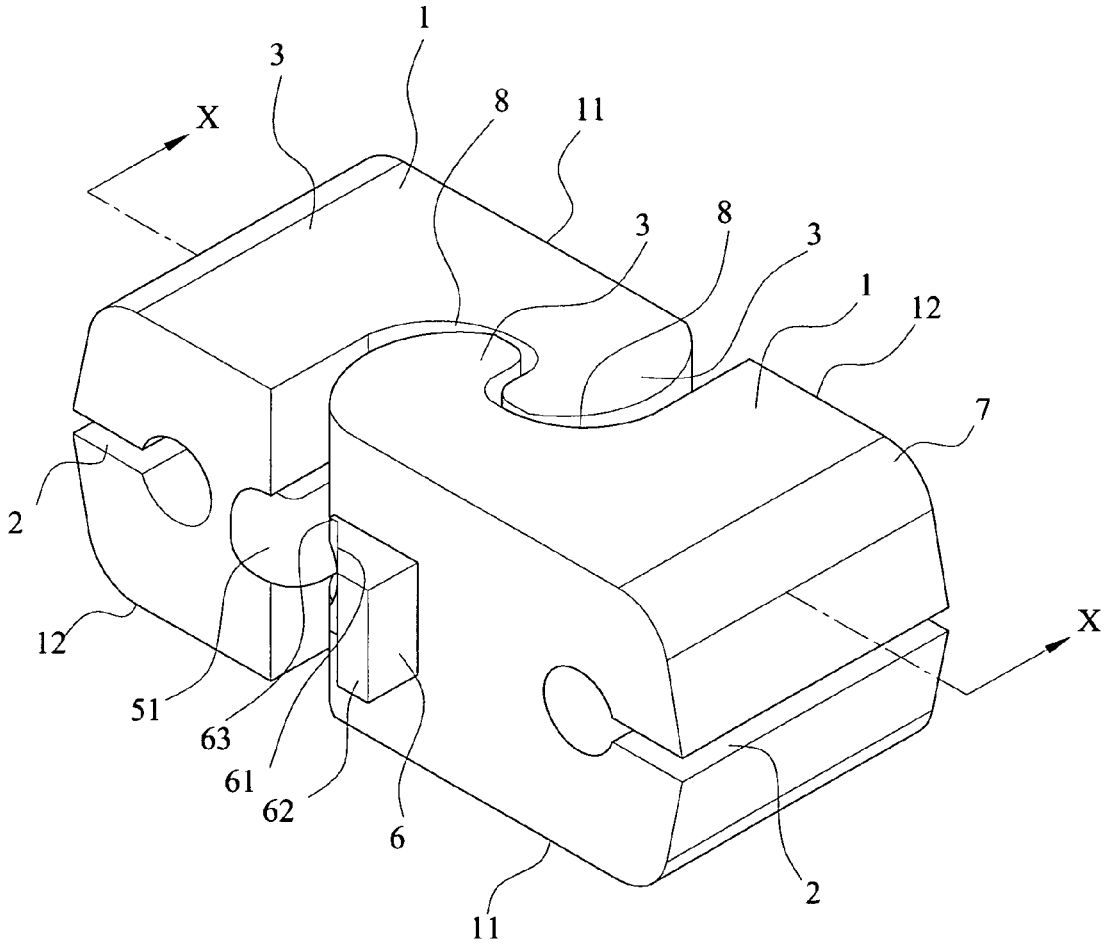
FIG. 9 is a schematic view showing an interlocking pair of teeth of the claimed zipper.
Figure 10:
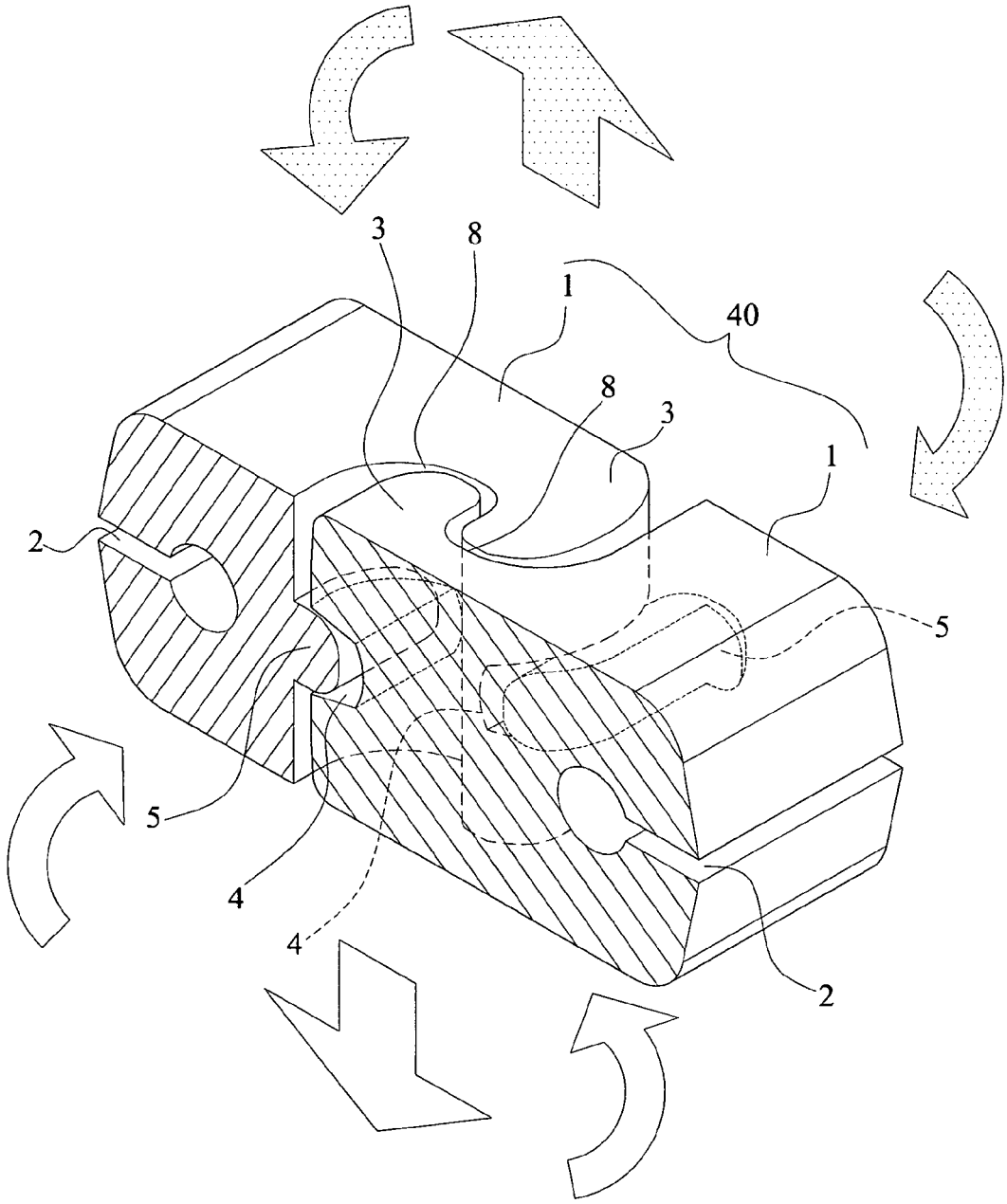
FIG. 10 is a sectional view of the tooth of FIG. 9 along the line X-X.

FIGS. 9 and 10 illustrate a partial of the chain (40) wherein two teeth (10) interlock each other as an interlocking pair, the tooth (1) on the right side of the pair is provided reversely for allowing the hook portion (3) of each engages the dimple (8) of another. Unlike the zigzag arrangement of the conventional zipper teeth, said interlocked teeth (1) are arranged in a horizontal fashion, having the left wall (12) of one tooth (10) and right wall of another set on a precisely horizontal plane. The horizontal arrangement secures the teeth (1) more tight than the zigzag fashion, preventing the teeth (10) from disengagement when are twisted or bent.

Figure 11A:
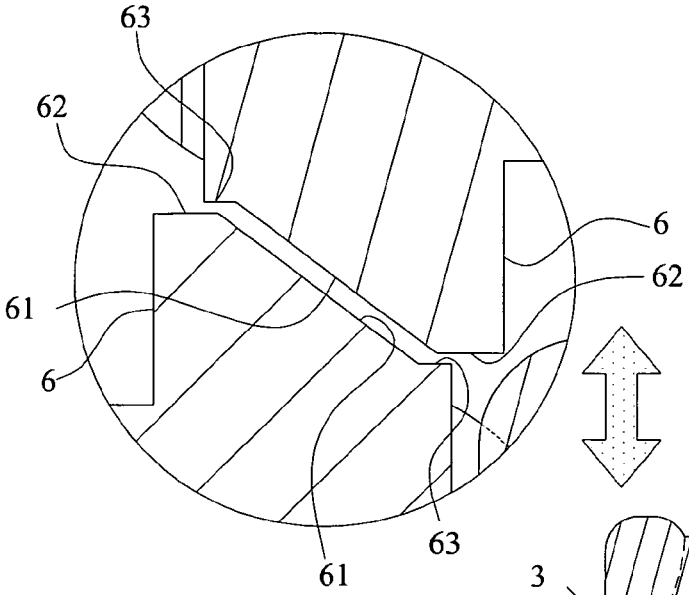
FIG. 11A is an enlarged view of the FIG. 11, focusing the attachment of two angled faces of the joint members.
Figure 11:
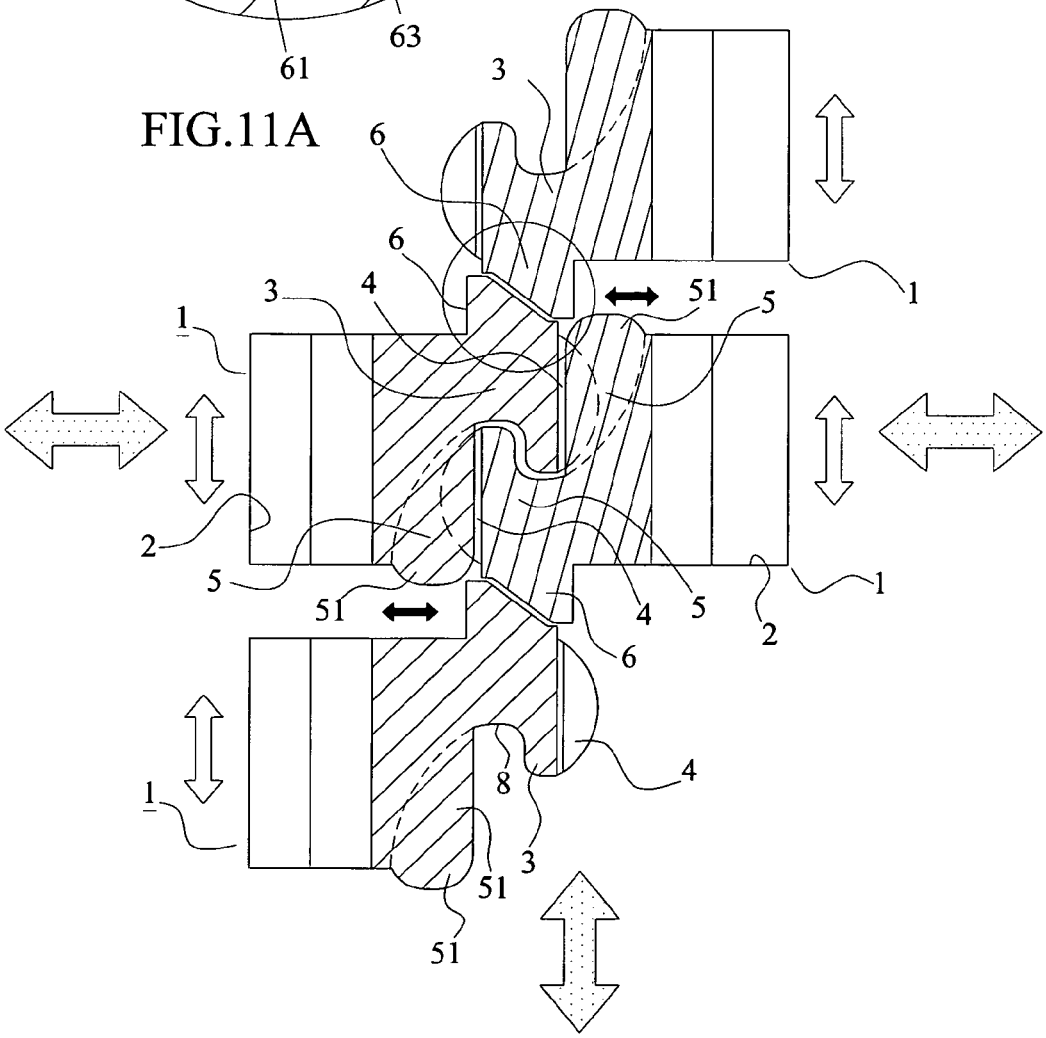
FIG. 11 is an illustrative view showing the stress distribution in arrows.

FIG. 11 shows the different directions of stress that are applied to the teeth (1). Each tooth (1) has the right-triangular-like joint member (6) projected from both the left and right walls (12, 11). The joint member (6) includes an angled face (61) which butts the angled face (61) of another, creating space between the teeth (10), allowing movability to the chain (40) when the teeth (10) are interlocked; and attached angled faces (61) give more flexibility to the chain (40).

Said joint member (6) further includes two plane and parallel top and bottom faces (62, 63) which extended from both ends of said angled face (61) respectively. As shown in FIG. 11A, the top face (62) butts the bottom face (63) of the tooth (6) above and bottom face (63) also butts the top face (62) of tooth (1) above. The plane surface provides a friction, which prevents the tooth (1) from sliding horizontally.

Figure 7:
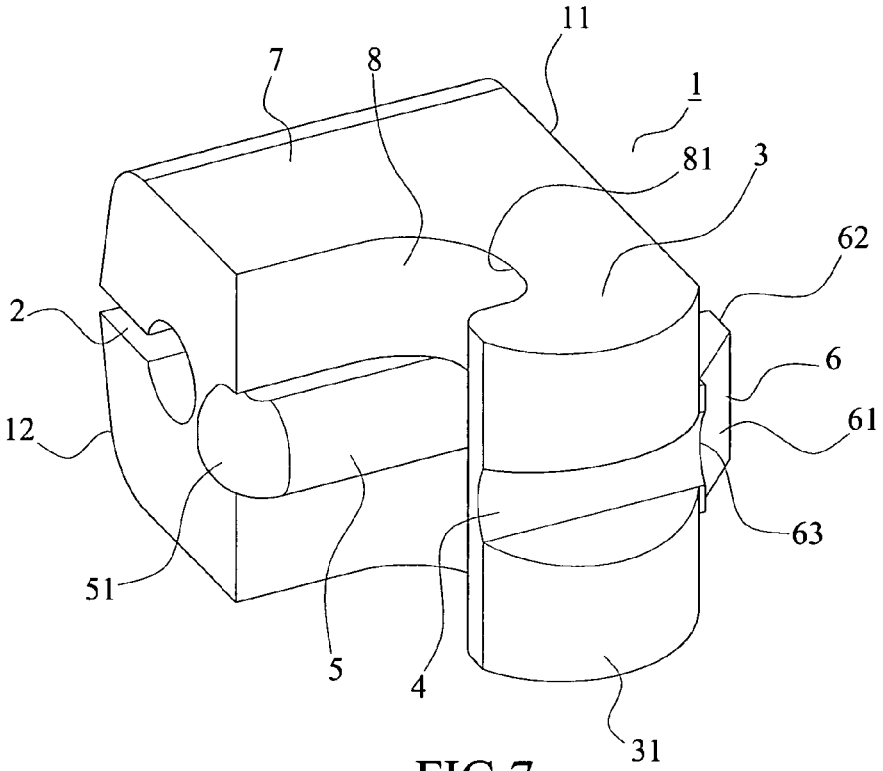
FIG. 7 is a schematic view of a tooth of the said claimed zipper.
Figure 8:
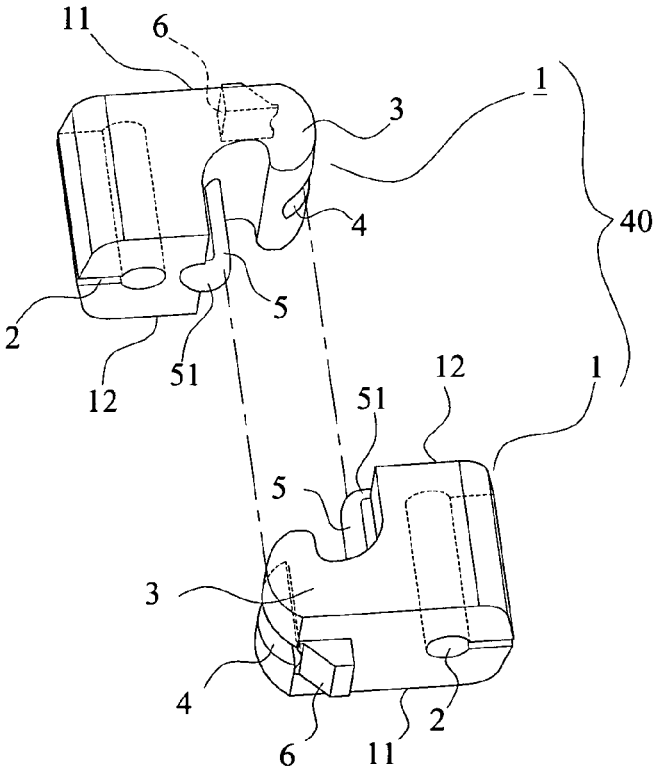
FIG. 8 is a schematic view showing two separated teeth of the claimed zipper.

Referring to FIGS. 7, 9 and 10, to improve the engagement, a slot (4) is provided on an outer wall of said hook portion (3) and a corresponding blocking member (5) is provided at the dimple (8); the blocking member (5) is extended horizontally and contacts with the left wall (12) of the tooth (1) by a curve wall (51). Thus, when the hook portion (3) interlocks the dimple (8), the slot (4) can couples the blocking member (5) and strengthen the chain (40) against vertical directional stress.

Referring to FIGS. 7, 10 and 11, said hook portion (3) is set to have a curved outer wall (31) and said dimple (8) is set to have a curved inner wall (81). The curvature surfaces facilitate the engagement of the teeth (1) and strengthen the teeth (1) against horizontal and longitudinal tension, Distinctive to the zigzag arrangement of the teeth of the conventional zipper, the zipper of the present invention comprises of pluralities of interlocking pair as shown in FIG. 9. Each pair functions independently and attaches other pair by the joint member (6), thus when disengagement is occurred to a single pair, user can still mesh or separate the teeth (1) properly by pulling the slider (50), avoiding a failure completely for a zigzag arranging fashion zipper.

The invention claimed is:

1. A tooth (1) of a slide fastener comprises:

a clamp portion (7) is provided on a side, having a slit (2) for receiving a fabric tape, one end of said clamp portion (7) forms a left wall (12) of said tooth (1);

a hook portion (3) is extended from another end of the clamp portion (7) forming a dimple (8) and a right wall (11) of said tooth (1);

a slot (4) parallel to said slit (2) is provided on an outer wall of said hook portion (3);

a blocking member (5) parallel to said slot (4) is provided at said dimple (8); and a joint member (6) is in a right triangle columnar shape with an angled face (61), protruding from said right wall (11) and adjoining to the slot (4).

2. The tooth (1) of claim 1, wherein said left and right wall (12, 11) are parallel.

3. The tooth (1) of claim 1, wherein both sides of said angled face (61) of said joint member (6) connect to a top face (62) and a bottom face (63) of said joint member (6); said top face (62) and bottom face (63) are parallel to the right wall (11).

4. The tooth (1) of claim 1, wherein said hook portion (3) has a curved outer wall (31) and said dimple (8) has a curved inner wall (81).

* * * * *